United States Patent [19]

Grant

[11] 4,137,050

[45] Jan. 30, 1979

[54] COAL DESULFURIZATION

[75] Inventor: Stephen L. Grant, Stow, Ohio

[73] Assignee: Standard Oil Company (Ohio), Cleveland, Ohio

[21] Appl. No.: 892,000

[22] Filed: Mar. 31, 1978

[51] Int. Cl.[2] ..... C10L 9/10; C10B 57/00; C22B 1/11

[52] U.S. Cl. ..... 44/1 R; 75/6; 201/17

[58] Field of Search ..... 44/1 R; 75/6; 201/17

[56] References Cited

U.S. PATENT DOCUMENTS

| | | | |
|---|---|---|---|
| 3,878,051 | 4/1975 | Long et al. | 201/17 |
| 4,071,328 | 1/1978 | Sinke | 44/1 R |

*Primary Examiner*—Carl Dees

*Attorney, Agent, or Firm*—Herbert D. Knudsen; John E. Miller, Jr.

[57] ABSTRACT

The pyritic sulfur content of coal can be significantly reduced by leaching the coal with an aqueous solution containing hexacyanoferrate (III) ions.

11 Claims, No Drawings

COAL DESULFURIZATION

BACKGROUND OF THE INVENTION

The present invention relates to a novel chemical leaching process for significantly reducing the pyritic sulfur content of coal.

Processes for removing pyritic sulfur from coal by chemical leaching operations are well known. An example of such a process is TRW's Meyer's process which is described in U.S. Pat. No. 3,768,988.

Although the Meyer's process is capable of removing significant quantities of pyritic sulfur from coal, it suffers from at least one known disadvantage. In particular, it has been found that in the practice of the Meyer's process, the heating value of the coal is degraded. This, of course, is disadvantageous because it reduces the amount of energy that can be recovered from coal.

Accordingly, it is an object of the present invention to provide a novel process for removing pyritic sulfur from coal which can be carried out very simply and easily and which does not degrade the heating value of the coal.

SUMMARY OF THE INVENTION

This and other objects are accomplished by the present invention which is based on the discovery that significant amounts of pyritic sulfur contained in coal can be removed from the coal by chemically leaching the coal with an aqueous solution containing the hexacyanoferrate (III) ion.

Thus, the present invention provides a novel process for removing pyritic sulfur from coal comprising contacting the coal with an aqueous solution containing the hexacyanoferrate (III) ion.

DETAILED DESCRIPTION

The inventive process is applicable to all types of coal. In this regard, it is well known that the chemical composition of coals obtained from different locations can vary widely. The inventive process can be practiced on all types of coal, although the amount of desulfurization attainable varies with the particular coal being processed.

The coal to be treated by the inventive process can be of any size although it should be in particulate form since this increases the contact of the aqueous leachant with the coal mass. Preferably, the particulate coal should have a particle size no larger than about ¼ inch since the efficiency of the process decreases at higher particle sizes. Below this value, however, it has been found that there is no particular criticality in the particle size of the coal, essentially the same results being obtained regardless of particle size. It is desirable, however, to avoid using coal of too fine a particle size, since as well known physical separation of extremely fine particles from an aqueous liquid can be difficult. For most convenient operation, the particle size of the coal should be roughly 100 mesh.

The leachant used to process coal in accordance with the present invention is an aqueous solution containing the hexacyanoferrate (III) ion $(Fe(CN)_6)^{-3}$. The concentration of the hexacyanoferrate (III) ion in the aqueous solution is not particularly critical and can vary over wide limits. Normally, the concentration of hexacyanoferrate (III) ion should be above about 0.1 normal in order that the sulfur removal capabilities of a leachant solution are significant. Any hexacyanoferrate (III) concentration from this value up to the saturation value can be employed with facility, a concentration of about 0.5 to 3 molar being preferred with a concentration of about 1 molar being most preferred.

The aqueous leachant containing the hexacyanoferrate (III) ions in accordance with the present invention should be acidic as this aids in leachant regeneration as discussed below. Therefore, it is preferable to include in the leachant a small amount of an acid in order to keep the pH below 7. The preferred acid is hydrochloric acid, although any acid can be employed. Nitric acid should be avoided since it tends to oxidize the organics in the coal. The amount of acid present in the leachant should be sufficient to lower the leachant pH below 7. Also, the use of too much acid should be avoided since in the presence of hot concentrated acid the hexacyanoferrate ion decomposes to produce HCN as a by-product. Although the use of an acidic leachant is desirable, it is not mandatory.

The leachant solution, of course, can contain other dissolved or suspended ingredients which do not interfere with the coal desulfurization procedure.

Hexacyanoferrate (III) ions can be supplied by means of any salt containing these ions. For example, potassium hexacyanoferrate, sodium hexacyanoferrate, ammonium hexacyanoferrate can be employed, these salts merely being dissolved in the water.

The amount of leachant contacted with a given amount of coal is also not critical. As a practical matter, the coal/leachant ratio should be at least 1/20 in order for the process to be economic although lower coal/leachant ratios can be employed if desired. Furthermore, when the coal/leachant ratio exceeds about 1.5/1, the mixture becomes too viscous. Therefore, it is preferable to operate with a coal/leachant ratio between about 1/20 to 1.5/1. Preferably the coal/leachant ratio is about 1/5.

The temperature at which the coal is contacted with the leachant can also vary widely. The process can be conducted at room temperature, although it is preferred that the temperature be at, near or above the boiling point of the leachant. Moreover, at temperatures above about 400° C., the hexacyanoferrate (III) ions begin to decompose. Thus, while it is possible to carry out the process at a temperature of about room temperature to 400° C., a range of 80–125° C. is preferred.

In accordance with the preferred embodiment of the invention the leachant is boiling when in contact with the coal. When operating in this manner, it is preferred that the process is carried out under reflux conditions, i.e. vapors driven off the leachant through boiling are condensed and returned to the leachant.

The contact time of the leachant with the coal necessary for significant sulfur removal varies depending on a number of factors such as the concentration of hexacyanoferrate (III) ions in the leachant and the particular coal being processed. Normally, contact times on the order of 1 hour to 24 hours are employed with a contact time of about 3 to 6 hours being suitable in many instances. Contact times as low as 15 minutes can be employed.

When the leaching procedure is finished, the processed coal and the leachant are separated from one another. This can be accomplished by any convenient technique such as, for example, filtering.

The treated particulate coal recovered in this manner can be used as is. However, it has been found in accordance with a further feature of the present invention that additional amounts of sulfur can be removed from the coal by washing the coal with an acid wash. Although not wishing to be bound to any theory, applicants believe that as a result of the inventive leaching procedure, some of the sulfur in the coal is transformed into iron sulfide which as known has limited solubility in neutral solutions and essentially no solubility in basic solutions. The iron sulfide remains in the coal particles when they are separated from the leachant. By washing the coal particles with water iron sulfide remaining in the coal can be removed therefrom. And if the water wash is acidic even greater amounts of iron sulfide can be removed due to the higher solubility of iron sulfide in acidic mediums.

In carrying out the acid wash, any acid can be used, although hydrochloric acid is preferred. Also, it is preferred to avoid using nitric acid as this tends to oxidize the organics in the coal. The concentration of acid in the aqueous acidic wash solution is not critical, concentrations ranging from 0.5 to 5 normal being preferred as most convenient. Also, it is desirable to water wash the coal after the acid wash to remove acid anions which may become entrained therein.

The spent leachant recovered from the processing operation can be discharged to waste if desired. It is preferred, however, to regenerate the spent leachant for reuse.

In this regard, it is believed that pyritic sulfur removal in accordance with the present invention is due to the oxidation of the pyritic sulfur, the oxidation occurring with a concomitant reduction of the hexacyanoferrate (III) ion $(Fe(CN)_6)^{-3}$ to the hexacyanoferrate (II) ion $(Fe(CN)_6)^{-4}$. Thus, in order to regenerate spent leachant, the leachant is processed so that the hexacyanoferrate (II) ion is oxidized back to the hexacyanoferrate (III) ion.

Oxidation of the hexacyanoferrate (II) ion can be accomplished by any means known in the art which does not destroy the hexacyanoferrate ion and which does not introduce ingredients into the leachant which would interfere with the sulfur removal process of the invention. Oxidation of the hexacyanoferrate (II) ion can be most easily be accomplished by simply bubbling air into the spent leachant solution. And, as indicated above, the leachant is preferably maintained at a pH below 7 since this aids the regenerating procedure.

The amount of air or other oxidants used to regenerate the spent leachant is not critical. Since an excess of molecular oxygen will not harm the hexacyanoferrate ion, it is most convenient to supply enough air so that there is a molar excess of oxygen. Similarly, a molar excess of any other oxidant will provide the best regeneration of the spent leachant, although less than a molar excess can be employed if desired.

In addition to the hexacyanoferrate (II) ion, the spent leachant also contains elemental sulfur. This elemental sulfur is present in the spent leachant in the form of particles, and it is desirable to remove these particles from the leachant from time to time in order to prevent the sulfur content of the leachant from being too great. Removal of the particulate elemental sulfur from the spent leachant can be easily be accomplished by mechanical means such as, for example, by filtering.

In accordance with the preferred embodiment of the present invention, processing of coal to remove pyritic sulfur therefrom and regeneration of hexacyanoferrate (III) ion in the leachant are accomplished simultaneously. This is easily done by bubbling air into the leachant during the coal treating procedure. By operating in this manner, it has been found that the leachant can continue to remove pyritic sulfur from coal with high efficiency over extended periods of time.

The coal product recovered from the inventive process can be used as is. However, if desired the product coal can be subjected to a conventional float-sink operation to remove ash and possibly additional sulfur therefrom.

In this regard, it has been found that the inventive treating process as discussed above not only removes sulfur from the coal but also causes at least some breaking up of the inorganic matrix of the coal. Thus when coal processed in accordance with the invention is subjected to a conventional float-sinking operation, more ash (the coal inorganics) than otherwise would be possible is removed from the coal during float-sinking. This, of course, enables the inventive process when practiced in conjunction with a conventional float-sinking operation to produce a coal product having a higher heat value than the raw coal starting material. In order for this advantageous result to be realized to a significant extent, the cation of the salt used to supply the hexacyanoferrate ion should be a Group I or II metal.

In order to more thoroughly describe the present invention, the following examples are presented.

EXAMPLE 1

A 100 gram sample of West Field coal (Indiana No. 5) containing 5.28% sulfur, 13.44% ash and having a heat content of 11,164 BTU/pound was ground to a particle size of 3/8 inch by 30 mesh. The coal was then added to 500 ml. of an aqueous solution containing 100 grams of $K_3Fe(CN)_6$. An immediate color change from yellow-red to green was noted and a blue precipitate formed. The composition was heated under reflux for 3 hours and then the solids were separated from the liquid, and the solids subjected to a conventional float-sink separation using $CCl_4$. The product coal contained 3.83% sulfur, 10.56% ash and had a heat content of 12,536 BTU/pound.

EXAMPLE 2

A 50 gram sample of Old Ben Mine 26 coal (Illinois No. 6) having a sulfur content of 2.35%, an ash content of 9.6% and a heat content of 12,028 BTU/pound was ground to 40 × 60 mesh. The coal was then added to 500 ml. of an aqueous solution containign 50 grams of $K_3FeCN_6$ and 5 grams HCl. The composition so obtained was heated to reflux for 12 hours and over that period 5,000 cc per hour of air were fed to the composition through an air sparger. After the 12 hour period, the solids were separated from the liquid and the solids subjected to a conventional float-sink separation using $CCl_4$. The treated coal was found to contain 1.82% sulfur, 7.00% ash and to have a heat content of 13,250 BTU/pound.

From the foregoing, it can be seen that the inventive process is capable of significantly reducing the pyritic sulfur content of coal in a very simple and straightforward manner. In addition, it can be seen that the pyritic sulfur removal procedure is accomplished with an increase rather than a decrease in the heat value of the coal. Thus, the present invention represents a significant improvement over processes in which the heating value of the coal is decreased when the pyritic sulfur is removed.

Although only a few embodiments of the present invention have been described above, it should be appreciated that many modifications can be made without departing from the spirit and scope of the invention. For example, the inventive process can be practiced on coal which has already been subjected to various processes, such as conventional float-sinking, as well as raw coal. All such modifications are intended to be included within the scope of the present invention, which is to be limited only by the following claims.

I claim:

1. A process for removing sulfur from coal comprising contacting the coal with a leachant comprising an aqueous solution containing the hexacyanoferrate (III) ion.

2. The process of claim 1 wherein said leachant has an acid pH.

3. The process of claim 2 wherein said coal is particulate in form and has a particle size of about ¼ inch or less.

4. The process of claim 3 wherein said leachant is heated to reflux during contact with said coal.

5. The process of claim 4 wherein air is bubbled into said leachant during contact of said leachant with said coal.

6. The process of claim 4 wherein said leachant is at least 0.1 molar in hexacyanoferrate (III) ion.

7. The process of claim 6 wherein leachant is 0.5 to 3 molar in said hexacyanoferrate (III) ion.

8. The process of claim 7 wherein said leachant contains hydrochloric acid.

9. The process of claim 6 further comprising separating said leachant from said coal thereafter washing said coal with water.

10. The process of claim 9 wherein said water contains an acid.

11. The process of claim 10 further comprising subjecting said coal to a second water wash free of acid.

* * * * *